United States Patent [19]

Gott

[11] Patent Number: 4,461,117

[45] Date of Patent: Jul. 24, 1984

[54] TOY GRENADE WITH FLASHCUBE

[76] Inventor: Richard J. Gott, Rte. 2, Box 193-B, Seaford, Del. 19973

[21] Appl. No.: 371,001

[22] Filed: Apr. 22, 1982

[51] Int. Cl.[3] ..... A63H 33/26

[52] U.S. Cl. ..... 446/473; 446/485

[58] Field of Search ..... 46/228, 226, 45, 200, 46/196

[56] References Cited

U.S. PATENT DOCUMENTS

| | | | |
|---|---|---|---|
| 2,611,214 | 9/1952 | Schur | 46/228 |
| 2,686,987 | 8/1954 | Garofalow | 46/200 |
| 3,580,575 | 5/1971 | Speeth | 46/228 X |
| 3,610,916 | 5/1970 | Meehan | 46/228 X |

*Primary Examiner*—Mickey Yu

*Attorney, Agent, or Firm*—Harvey B. Jacobson

[57] ABSTRACT

A toy grenade utilizes a self-powered camera flashcube in which one of the flash bulbs is activated upon an impact of the grenade with a surface after being thrown. The grenade includes fins at one end and a weight at the other end for providing a stabilized flight with the weight being rubber or the like and is designed for impact with the ground or other surface. Supporting the weight is a flexible resilient member, such as a wire, which is fixably connected to the body of the grenade. An actuating member extends from the weight through a hole in the grenade body so that it will enter one of the peripheral slots on the flashcube so that upon impact of the grenade on a surface, the actuating member moves into contact with a peripheral contact on the flashcube so as to activate the associated bulb in the flashcube in exactly the same manner that the bulbs in the flashcube are activated when mounted on a camera. The flashcube is contained within a transparent cylindrical shield which may be tinted or colored for effect and which effectively permits an efficient dispersion of the light generated by the activated flashcube bulb so as to visually simulate a grenade explosion. A safety wedge is provided to retain the actuating member in a non-activating position when reloading the grenade with an unused flashcube or when handling the grenade.

11 Claims, 5 Drawing Figures

FIG. 1
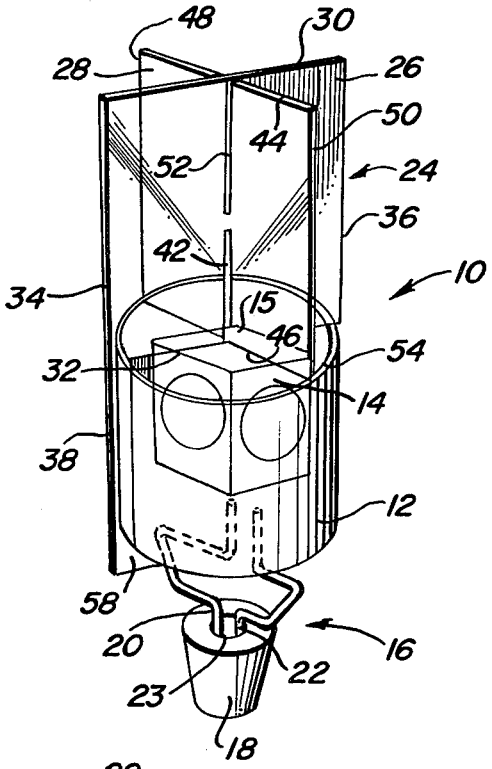
FIG. 2
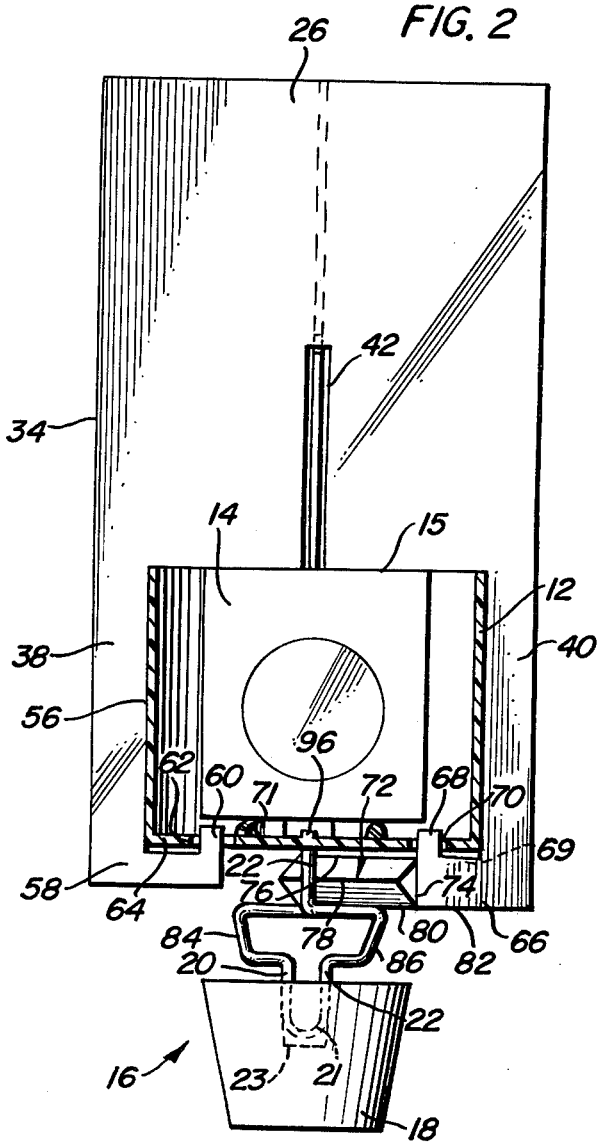
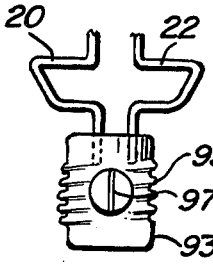
FIG. 5
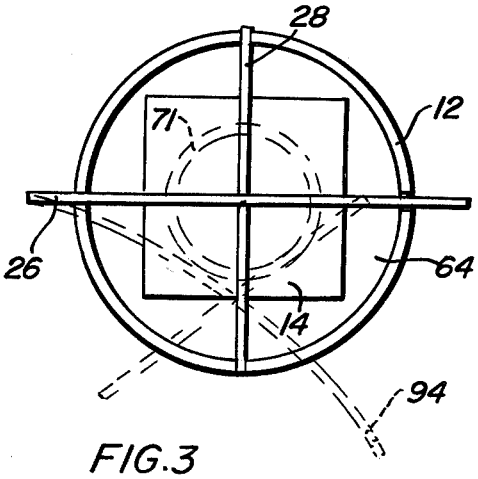
FIG.3
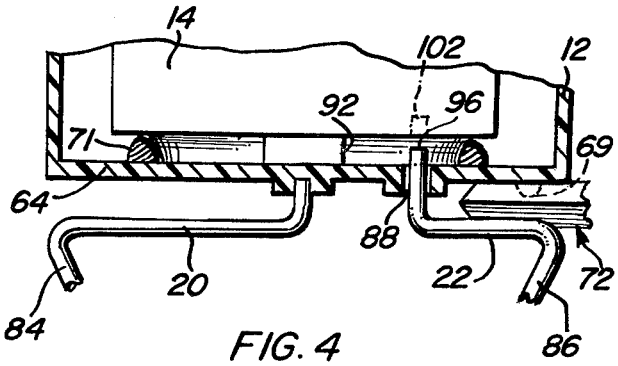
FIG. 4

TOY GRENADE WITH FLASHCUBE

BACKGROUND OF THE INVENTION

1. Field of the Invention

The present invention relates to toys which emit light and more particularly relates to toy grenades which emit a flash of light to visually simulate an explosion.

2. Description of the Prior Art

With respect to light emitting toys, there has been at least some attempts to develop aerial toys which have a light producing and emitting capability. In this respect, U.S. Pat. No. 3,528,659, issued to J. Benham on Sept. 15, 1970, discloses an aerial projectile toy which essentially consists of a rod designed to be twirled through the air by the use of a second propelling rod which imparts the twirling action. The twirled rod utilizes spring loaded batteries which, in response to the centrifugal force generated by the twirling action, come into contact with light bulbs positioned in the ends of the rod so as to illuminate the same as it moves through the air. Once the twirling action slows down, the batteries break contact with the respective light bulbs and the illumination thereof ceases. Of course, the lighting effect achieved by the twirled rod is of a continuous nature as long as the rod is twirling sufficiently fast and no provision is made for a flash of light for visually simulating an explosion upon an impact of the rod with the ground. To the contrary, no light is generated when the twirled rod strikes a surface.

In U.S. Pat. No. 3,731,928, issued to W. Wolfe on May 8, 1973, there is disclosed an athletic training device which essentially consists of a training ball having a translucent portion and a spark producing device mounted inside the ball and movable across an abrasive surface also contained therein. Deformation of the ball upon impact results in a relative movement between the abrasive surface and the spark producing member to create a spark that is visible through the translucent portion of the outer spherical member. Similarly, any impact of the ball such as by a bat, hand, foot, etc., will generate a spark within the ball. This device, however, is not intended to visually simulate an explosion and does not create a very bright light as might be expected through the use of a flashcube. Further, the ball is not intended for use as a toy, such as a toy hand grenade, but is rather envisioned as being used strictly as a training device whereby a ballplayer can determine a point of impact of the ball upon its striking the ground in a field.

SUMMARY OF THE INVENTION

The present invention, which will be described subsequently in greater detail, comprises a toy hand grenade constructed substantially of translucent material and in which an explosion may be visually simulated through the use of a self-powered camera flashcube, such as a "Magicube". The grenade includes a translucent cylindrical shield into which a "Magicube" may be inserted. Translucent stabilizing fins are provided at one end of the cylindrical shield and a rubber or noise producing weight is provided at the other end, such weight then serving as the contact point of the grenade with a surface upon its impact therewith after the grenade has been thrown. The weight has a pair of resilient wire members extending therefrom, such wires being integrally connected together and one of which is an actuating member and serves to activate the "Magicube" so as to activate or "flash" one of the bulbs when the weight strikes a surface. The other wire has its upper end attached to the grenade body to resilient and flexibly support the weight from the grenade body. The actuating wire extends through a hole in the grenade body and terminates in normally spaced but aligned relationship to one of the peripheral activating contacts associated with an "unflashed" bulb on the flashcube, whereby the impact of the weight with a surface forces the actuating wire member into contact with the peripheral firing contact on the "Magicube" so as to activate or "flash" the bulb to visually simulate an explosion. The translucent fins may be conveniently removed or displaced from the end of the cylindrical shield so that the flashcube can be rotated to align another "unflashed" bulb with the movable activating wire member or to remove a used flashcube and to insert an unused flashcube therein, and a safety wedge is provided which effectively holds the movable actuating wire member away from the peripheral activating contacts during insertion of an unused flashcube into the shield and during storage or handling. Similarly, the safety wedge may at all times be utilized to prevent the activation of a flashcube, such as might occur in the event of an inadvertent dropping of the toy grenade on the floor.

It is therefore an object of the present invention to provide a new and novel light-emitting toy which utilizes self-powered flashcubes and will safely visually simulate an explosion.

Another object of the present invention is to provide a reusable aerial toy that will provide a flash of light upon an impact with a surface.

A further object of the present invention is the provision of a light-emitting aerial toy which may be economically and easily manufactured.

A still further object of the present invention is to provide a light-emitting toy grenade that doesn't utilize batteries thereby maintaining a lightweight construction to substantially reduce the danger of breaking glass, such as in windows, tables, or the like, when the same are struck by the grenade.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the toy grenade forming the present invention.

FIG. 2 is a side elevational view, on an enlarged scale partly in section, of the invention.

FIG. 3 is a top plan view of the invention illustrating the flashcube receptacle and how the fins may be conveniently displaced.

FIG. 4 illustrates an enlarged partial structural view, partly in section, detailing the association of the pair of wires to the grenade body and a flashcube.

FIG. 5 illustrates an alternative embodiment of the weight operably associated with the present invention.

DESCRIPTION OF THE PREFERRED EMBODIMENT

Reference is now made to the drawings and, in particular, to FIG. 1 wherein there is illustrated in detail a toy grenade forming the preferred embodiment of the present invention and generally designated by the reference numeral 10. In this respect, the toy grenade 10 includes a translucent cylindrical shield member 12 into which is positionable a self-powered camera flashcube 14 such as a "Magicube" which is a commercially available product having four flash bulbs and being further provided with a central support disposed as a downwardly opening socket in a depending projection normally rotatably mounted on a camera. The flashcube 14 also includes four peripherally spaced activating contacts, one for each bulb, which are selectively and normally engaged by a movable actuator of the camera to "flash" the bulb. A surface impacting portion 16 of the present invention includes a rubber weight 18 from which protrudes first and second integrally connected trigger wires 20, 22, respectively. The wire 20 is fixedly attached to the central portion of the grenade body as set forth hereinafter and the wire 22 extends through a hole in the grenade body and terminates in an end portion 96 in normally spaced and aligned relationship to one of the peripheral activating contacts on the flashcube with the wire 22 thus serving as an actuating member to engage an activating contact to "flash" or activate a bulb when the toy grenade strikes a surface.

The toy grenade 10 further includes a set of stabilizing fins 24 located proximate and attached to the translucent cylindrical shield member 12 and including a first fin section 26 and a second fin section 28. The first fin section 26 is of a substantially rectangular planar construction having a top edge 30, a bottom edge 32, and a pair of parallel, aligned, spaced-apart side edges 34, 36. Additionally, the first fin section 26 includes a pair of extensions 38, 40 which will be subsequently discussed in greater detail. Further, the first fin section 26 is provided with a slot 42 which is cut therein in a direction away from the bottom edge 32 and towards the top edge 30. The slot 42 is centrally positioned along the bottom edge 32 and is parallel with the side edges 34, 36. Preferably, slot 42 will be of a length which is approximately half the distance between the top and bottom edges 30, 32, respectively.

Similarly, the second fin section 28 is of a rectangular planar shape and has parallelly aligned top and bottom edges 44, 46, respectively, as well as parallelly aligned sides edges 48, 50. Further, a slot 52 is cut in the second fin section 28, such slot being centrally disposed on the edge 44 and directed orthogonally therefrom in parallel alignment with the side edges 48, 50 for a distance approximately half the distance between the respective top and bottom edges 44, 46.

As can be appreciated with further reference to FIG. 1, the first and second fin sections 26, 28, respectively, are orthogonally and rigidly positioned with respect to each other and are aligned and assembled such that their respective slots 42, 52 are aligned along the same longitudinally extending axis. In this connection then, it can be seen that the slot 42 allows the second fin section 28 to be positioned therein, while the slot 52 allows the first fin section 26 to be slidably positioned therein. As such, the assembled construction illustrated in FIG. 1 is possible, and the slots 42, 52 enable assembly of the fin sections 26, 28 so that the top edges 30, 44 are aligned in substantially the same plane. At the same time, the respective bottom edges 32, 46 lie in substantially the same plane and additionally are in abutting relationship with a top edge 54 of the translucent cylindrical section 12 and a top surface 15 of the flashcube 14 so as to achieve maximum stability during flight and impact of the grenade 10.

Referring now to FIG. 2 of the drawings, which is a side elevational view of the toy grenade 10, a better understanding of the structural details of the present invention can be ascertained. In this connection, it will be noted that the aforementioned extensions 38, 40 are integrally attached to and lie substantially in the same plane as the first fin section 26. As illustrated, the extension 38 has an outside edge which is essentially an extension of edge 34 associated with the first fin section 26, and an inside edge 56 which is parallel with and spaced apart from the edge 34. Additionally, a tabular portion 58 is illustrated which is directed inwardly towards a central longitudinally extending axis of the toy grenade 10. Further, the tabular portion 58 has an upwardly directed projection 60 which is designed for engagement with an aperture 62 located in base plate 64, such base plate forming an end wall associated with the cylindrical shield 12.

Similarly, extension 40 has an inwardly projecting tabular portion 66, such tabular portion also including a projection 68 which is engageable with a second aperture 70 located in the base plate 64. As clearly illustrated in FIG. 2, the engagement of the projections 60, 68, respectively, in the apertures 62, 70 is used to firmly attach the first fin section 26 to the cylindrical section 12. This attachment by necessity also assures that the second fin section 28 will be held in an abutting relationship with the cylindrical section 12, due to the particular construction and alignment of the slots 42, 52.

The tabular portion 66 differs slightly from the tabular portion 58 in that an additional wedge member 72 is fixedly attached thereto. In this connection, the wedge member 72 is integrally attached to the tabular portion 66 and is angled therefrom along a vertical crease line 74. Since it is envisioned that the first and second fin sections 26, 28, respectively, would normally be constructed of a pliable translucent plastic material, the crease line 74 is formed by a bending of material and is then effectively retained in a permanent and rigid bent position. The wedge member 72 itself is formed by a vertically extending piece of plastic material which is provided with a first longitudinal crease line 76 and a second longitudinal crease line 78, thereby permitting the wedge member to be formed through a sequential bending of the material in the same direction along each of the respective crease lines 76, 78 so as to form the hollow triangularly shaped wedge member 72 illustrated in FIG. 2. In this respect, the lower longitudinal edge portion 80 of the wedge member 72 is brought into contact with a lower edge 82 of the tabular portion 66 and is then attached thereto by conventional means, such as by gluing or the like, so as to complete the construction of the triangularly shaped wedge member 72.

Also illustrated in FIG. 2 is a clear depiction of the construction of the surface impacting portion 16. As shown, the wire 20 and the wire 22 are integrally joined together by a simple U-shaped bend 21 and are retained in the rubber weight 18 by a wedging of the band in an aperture 23 or the bend may be encapsulated in the weight. Additionally, both wires 20, 22 have horizontal laterally open U-shaped bends 84, 86, respectively, formed therein. These bends 84, 86 serve as resilient spring means to absorb shock imparted to the rubber weight 18 upon an impact with a surface. Further to be noted with respect to FIG. 2 is the operable connection of wire 20 to the base plate 64. In this connection, it is well known in the prior art that self-powered flashcubes are provided with their own activating energy source and can be activated simply by pushing any thin object, whether a conductor or an insulator, into one of the peripheral slots on the bottom of the flashcube, respective the slots containing the abovementioned flashcube contacts. As such, the wire 20 is permanently attached to the base plate 64, while an aperture 88 (FIG. 4) is provided in the base plate through which actuating wire 22 extends. In this respect, the aperture 88 is of a greater diameter than the through extending wire 22 so that the wire 22 may reciprocally move therethrough. In that the wire 22 is longitudinally aligned so as to be in position to strike a peripheral contact associated with the flashcube 14, an upward movement of wire 22 through the aperture 88 into engagement with a peripheral contact will result in the associated bulb of the flashcube being activated or "flashed". In this respect, it can be seen that a topmost surface of the base plate 64 is provided with a structure duplicative of that which supports a flashcube of this type on a camera or a less expensive version may be used since it is not necessary to provide a rotating mechanism but only a socket arrangement 92 and an upstanding circular rim or border 71 which is designed to prevent sparks from flying outwardly from the center attachment portion of the flashcube 14.

FIGS. 2 and 4 also serve to illustrate the use of the wedge member 72 in conjunction with the U-shaped bend 86. Specifically, the wedge member 72 may be positioned as illustrated so as to effectively block any movement of U-shaped bend 86 in a direction toward the base plate 64, thereby preventing an upward movement of the wire 22 through the aperture 88 and into engagement with a peripheral contact of a flashcube 14. As such, the wedge member 72 in this position functions as a safety device which prevents an undesired activation of the flashcube 14. The wedge member 72 may be moved into a position which does not interfere with an upward movement of the U-shaped bend 86 towards the base plate 64, thereby arming the toy grenade so that a activation of the flashcube 14 may occur. This arming and disarming positioning of the wedge member 72 is effected through a movement of the respective fin sections 26, 28 during a replacement of a flashcube 14, as will be subsequently described in greater detail with reference to FIG. 3 below.

FIGS. 3 and 4 viewed concurrently further illustrate the particular construction of the base plate 64. As shown, the base plate 64 may be of a circular configuration which extends substantially out to and may be integrally a part of the cylindrical shield 12 so as to effectively completely close one end of the cylindrical shield, and a socket 92, constructed identically to or similar to the socket normally provided on cameras to permit the insertion and removal of the projection on a flashcube therein in a manner well understood, with the flashcube being manually rotated or automatically rotated ¼ turn after each flash depending upon the structure of socket 92. The base plate 64 includes one hole into which the permanently attached wire 20 is received which may be at the center or spaced from the center of the base plate 64 and the plate 64 also includes hole 88 through which reciprocal movement of wire 22 is permitted. Additionally, due to the flexible construction of the first and second fin sections 26, 28, it can be seen that the fin sections may be temporarily moved to a different location, such as illustrated by the broken lines 94, to thereby permit the removal and insertion of flashcubes 14 into the cylindrical shield 12. As such, it can be seen that such movement is accomplished by disengaging the projection 68 from the aperture 70, as shown in FIG. 2, and then pivoting the fin sections 26, 28 about an axis defined by the positioning of the projection 60 in the aperture 62, i.e., the fin sections effectively rotate about the projection 60 as to reach the position 94 shown in FIG. 3. Further, during such movement of the fin sections 26, 28 to position 94, the wedge member 72 is directed into a disarming position between the base plate 64 and the U-shaped bend 86. Accordingly, the wedge member 72 prevents the actuating wire 22 from moving upwardly into contact with one of the peripheral contacts associated with the flashcube 14 during an insertion or removal of the flashcube from the cylinder 12. The wedge member 72 as such then acts as a safety device to prevent an inadvertent activation of a flashcube 14 during a flashcube replacement or rotating operation or when storing or handling the grenade. Further, as shown in both FIGS. 2 and 4, a downwardly extending tab or stop 69 may be provided on the bottommost surface of the base plate 64, whereby the fin sections 26, 28 may only be rotated about the projection 60 in one direction to reach the position 94. In other words, the stop 69, in the embodiment shown, prevents a counterclockwise movement of the fin sections 26, 28 so that it can be assured that the wedge member 72 will be brought into a grenade disarming position between the base plate 64 and the U-shaped bend 86 associated with the wire 22. Of course, it can be appreciated that if the stop 69 were not present, the fin sections 26, 28 could be rotated in the opposite direction whereby the wedge member 72 would not be utilized, thus substantially increasing the chance of an inadvertent activation of one of the bulbs in a flashcube during a replacement operation.

FIG. 4 further illustrates the specific attachment of wire 20 to the base plate 64 in a fixed and permanent attachment thereto to thereby serve as the exclusive attachment means of the surface-impacting portion 16 to the cylindrical shield 12. Similarly, the actuating wire 22 is shown positioned within the aperture 88 and reciprocally movable relative thereto, such wire having an end 96 spaced apart and out of contact with a peripheral contact of the flashcube 14. Upon movement of the wire 22 toward the position 102 as indicated by the broken lines, a contact is established between the wire end 96 and the peripheral contact of the flashcube 14 to thereby activate the bulb with which the contact is associated in a conventional manner with the bend 86 serving to retain the weight 16 in alignment of the center of shield 12.

FIG. 5 has been provided to illustrate an arrangement in which the rubber weight 16 is replaced with a weight 93 which is also a sound producing device. In this respect, the weight 93 might be provided with a bellows air chamber 95 having a reed or whistle 97 operably attached thereto whereby an expulsion of air through the whistle 97 during an impact of the grenade with a surface would provide a sound in addition to the flash. In this connection, weight 93 is symbolic of any impact-triggered sonic device.

In use, it can be appreciated that an operator need only to position a flashcube 14 in the cylindrical shield 12 which can be accomplished through the rotation of the first and second fin sections 26, 28, respectively, about the projection 60 in aperture 62. Once the flashcube 14 is attached to the socket 92, the toy grenade is effectively ready for use, and to prevent a premature activation of the flashcube 14, the wedge member 72 has automatically been pulled inwardly during the aforementioned rotation of the fin sections 26, 28 so as to block movement of the U-shaped bend 86 toward the base plate 64, to thereby prevent engagement of the actuating wire 22 with the peripheral contact of the flashcube 14. When it is desired to utilize the toy grenade 10 so as to visually simulate an explosion thereof, it is only necessary to rotate the fin sections 26, 28 back into position so as to move the wedge member 72 out of engagement with the U-shaped bend 86, thus permitting a reciprocal movement of wire 22 through the aperture 88. As such, the toy grenade 10 may then be tossed into the air in a manner simulative of a hand grenade and the rubber end 18, due to its weight, will be the first part of the grenade to strike the ground. In this respect, the flight of the toy grenade 10 through the air is stabilized by the first and second fin sections 26, 28.

Upon striking the ground and with particular reference to FIG. 2 of the drawings, it can be appreciated that the U-shaped bend 84 will absorb some of the shock of the impact, while the actuating wire 22 will be driven upwardly through the aperture 88 and into contact with the peripheral contact on the flashcube thereby activating one of the bulbs. In that the cylindrical shield 12, as well as the first and second fin sections 26, 28, are all constructed of a translucent material, the light from the detonating bulb will be dispersed therethrough in a manner visually simulative of an explosion. For added effect, the material from which the fin sections 26, 28 and the cylindrical shield 12 is constructed may be tinted or colored, while the rubber weight 16 may be replaced with an impact-triggered sonic weight 93 as described with reference to FIG. 5 of the drawings.

When a bulb has been activated or once all of the bulbs on a flashcube 14 have been activated, the fin sections 26, 28 may again be rotated about the cylindrical shield 12 so as to permit rotation of the flashcube ¼ turn or removal of the used flashcube and replacement thereof.

It is also within the purview of the present invention to utilize conventional flashcubes and separate batteries rather than "Magicubes". In this event, the actuating wire 22 will close a circuit between the battery or batteries and one of the bulbs in the flashcube will be "flashed" when the wire is moved in response to the rubber weight 18 impacting against the ground surface or any other surface.

As can be appreciated, many of the constructional details of the present invention, such as the shape of the fin sections 26, 28, the type of material used, etc., may be varied without departing from the scope of the invention. Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to, falling within the scope of the invention.

What is claimed as new is as follows:

1. A light-emitting toy, said toy comprising:

a body section;

light-emitting means for producing a "flash" visually simulative of an explosion associated with said body section and having activating contact means;

means engageable with said contact means operatively connected to said body section and serving to activate said light-emitting means in response to the toy being thrown and impacting in a manner simulative of a grenade so as to actuate said means engageable with said contact means to cause an emission of light from said light-emitting means visually simulative of a grenade explosion, said light-emitting means comprising a camera flashbulb.

2. The light-emitting toy as defined in claim 1, wherein said body section includes impact means for controlling movement of said light-emitting toy so as to insure the operation of said means engageable with said contact means in a manner facilitating said emission of light.

3. The light-emitting toy as defined in claim 2, wherein said body section includes movement stabilizing fins for controlling the trajectory of said light-emitting toy.

4. The light-emitting toy as defined in claim 3, wherein said impact means comprises a weight member which is designed for contact with a surface when said aerial movement of said toy ceases, said weight member moving in response to said contact to operate said means engageable with said contact means thereby effecting said emission of light.

5. The light-emitting toy as defined in claim 1, wherein said flashbulb is self-powered flashcube so as to be activated upon the activating of said activating contact means therein.

6. The light-emitting toy as defined in claim 5, wherein said means engageable with said contact means comprises an actuating wire member to activate said activating contact means in said flashcube.

7. The light-emitting toy as defined in claim 6, wherein said means engageable with said contact engaging means includes a supporting wire member connected to the body section and impact means connected to said wire members.

8. The light-emitting toy as defined in claim 7, wherein said actuating wire member has a terminal end spaced from and aligned with the detonating contact means thereby activating said flashcube when said terminal end moves into contact with and actuates said activating contact means in the flashcube.

9. The light-emitting toy as defined in claim 8, wherein an engagement of said impact means with a surface after said toy completes an aerial movement results in said terminal end coming into contact with said activating contact means in said flashcube.

10. A light-emitting toy, said toy comprising:

a body section;

light-emitting means for producing a "flash" visually simulative of an explosion associated with said body section and having activating contact means;

means engageable with said contact means operatively connected to said body section and serving to activate said light-emitting means in response to the toy being thrown and impacting in a manner simulative of a grenade so as to actuate said means engageable with said contact means to cause an emission of light from said light-emitting means visually simulative of a grenade explosion, said body section including impact means for controlling movement of said light-emitting toy so as to insure the operation of said means engageable with said contact means in a manner facilitating said emission of light, said body section including movement stabilizing fins for controlling the trajectory of said light-emitting toy, said toy being an aerial movement toy with said aerial movement occurring as a result of said toy being thrown through the air, said impact means comprising a weight member which is designed for contact with a surface when said aerial movement of said toy ceases, said weight member moving in response to said contact to operate said means engageable with said contact means thereby effecting said emission of light, said stabilizing fins being movable so as to permit access to said light-emitting means, said light-emitting means being a camera flashcube.

11. A light-emitting toy, said toy comprising:

a body section;

light-emitting means for producing a "flash" visually simulative of an explosion associated with said body section and having activating contacting means;

means engageable with said contact means operatively connected to said body section and serving to activate said light-emitting means in response to the toy being thrown and impacting in a manner simulative of a grenade so as to actuate said means engageable with said contact means to cause an emission of light from said light-emitting means visually simulative of a grenade explosion, said body section including impact means for controlling movement of said light-emitting toy so as to insure the operation of said means engageable with said contact means in a manner facilitating said emission of light, said body section including movement stabilizing fins for controlling the trajectory of said light-emitting toy, said toy being an aerial movement toy with said aerial movement occurring as a result of said toy being thrown through the air, said impact means comprising a weight member which is designed for contact with a surface when said aerial movement of said toy ceases, said weight member moving in response to said contact to operate said means engageable with said contact means thereby effecting said emission of light, said stabilizing fins being movable so as to permit access to said light-emitting means, and safety means positionable to prevent activation of said light-emitting means when said stabilizing fins are moved into a position permitting access to said light-emitting means.

* * * * *